United States Patent [19]

Origuchi

[11] 4,453,649

[45] Jun. 12, 1984

[54] CONSTRUCTION FOR CONTAINING PLASTIC FILM

[75] Inventor: Shingo Origuchi, Tokyo, Japan

[73] Assignee: Idemitsu Kosan Company Limited, Tokyo, Japan

[21] Appl. No.: 315,815

[22] Filed: Oct. 28, 1981

[30] Foreign Application Priority Data

Nov. 28, 1980 [JP] Japan ..... 55-168412
Feb. 27, 1981 [JP] Japan ..... 56-28093

[51] Int. Cl.[3] ..... B65H 3/58

[52] U.S. Cl. ..... 221/26; 221/45; 206/554; 242/55.53

[58] Field of Search ..... 221/26, 33, 45, 27, 221/28, 55, 36, 46, 47; 206/554, 490, 494, 409, 390; 242/55.53, 55.2

[56] References Cited

U.S. PATENT DOCUMENTS

| | | | |
|---|---|---|---|
| 425,033 | 4/1890 | Hicks | 206/389 |
| 733,283 | 7/1903 | Scott | 206/389 |
| 1,170,590 | 2/1916 | Wheeler | 206/389 |
| 3,266,666 | 8/1966 | Nelson | 221/48 |
| 3,338,398 | 8/1967 | Altman | 206/554 X |
| 3,979,019 | 9/1976 | Bliss | 221/48 |
| 4,305,503 | 12/1981 | Membrino | 206/554 |

FOREIGN PATENT DOCUMENTS

| | | | |
|---|---|---|---|
| 2387182 | 10/1978 | France | 221/45 |
| 52431 | of 1979 | Japan . | |

*Primary Examiner*—Joseph J. Rolla
*Assistant Examiner*—Kevin P. Shaver
*Attorney, Agent, or Firm*—Flynn, Thiel, Boutell & Tanis

[57] ABSTRACT

A construction for containing a continuous plastic film is disclosed which is partitioned into a multiplicity of sections, each section of which is of a bag form or a sheet form. In this containing construction, the plastic continuous film is folded in such a manner that linear cuts formed in the plastic film are superposed one right on another. The plastic film is contained in a container in such a state that an insert member or members are inserted through the linear cuts thus superposed. In taking out the film, an end portion of the film is drawn out of a film take-out opening to the outside, such that a section of film of a predetermined length is drawn out and cut off at a linear cut portion by the insert member or members, and, as the film is cut off, an end portion of the succeeding, i.e. second, film section is adapted to be automatically drawn out to the take-out opening by the action of the connected film portions flanking the linear cut portions, whereby the sections of plastic film contained in the container are easily and reliably taken out one after another in the same manner as in a pop-up take-out method applied to tissue paper.

23 Claims, 20 Drawing Figures

CONSTRUCTION FOR CONTAINING PLASTIC FILM

BACKGROUND OF THE INVENTION

1. Field of the Invention

This invention relates to a construction for containing a continuous plastic film partitioned into a multiplicity of sections, each section of which is of a bag form or a sheet form used as a trash bag or a sheet for wrapping, and particularly to such a construction, from which each section of the plastic film can be taken out in a predetermined bag or sheet form.

2. Description of the Prior Art

Heretofore, there have been proposed various containers in which a multiplicity of bags made of plastic such as polyethylene are to be drawn out therefrom one after another when necessary. Nevertheless, such a bag made of plastic has a frictional resistance by far smaller than a piece of tissue paper, so that drawing out of one bag cannot bring the succeeding bag to a take-out opening by use of the staggered fold-in type pop-up take-out method commonly used in the case of tissue paper, so that the latter method is not practicable for use with plastic bags.

In view of the above, there has been proposed a construction, in which continuous plastic bags formed thereon with perforated lines are folded and superposed on one another, these folded bags are received in a container box, and, when a bag is to be drawn out, the aforesaid perforated line is brought into contact with a ridge (corner) of the container box to thereby tear the bag off (Japanese Utility Model Registration Application "Kokai" (Laid-Open) No. 52431/79). The above arrangement, however, is disadvantageous in that, when the bag is to be drawn out, the container box must be firmly held, and no such readiness in handling can be offered as with the pop-up take-out method applied to tissue paper.

Further, there has been proposed such a construction that plastic bags which have been separated from one another are superposed in a container, with each bag being partially overlapped onto the succeeding one, to thereby generate a force resisting drawing out of the bag. With the above arrangement, however, the bags could not always be drawn out one after another, but on the contrary several bags tend to be drawn out together, whereby useless bags are accumulated in a large number, thus proving to be uneconomical.

SUMMARY OF THE INVENTION

The present invention has as its object the provision of a construction for containing plastic film, that is, a plastic film dispenser having the readiness of the pop-up take-out method as in the case of tissue paper and enabling reliable drawing out of individual sections of bag-shaped or sheet-shaped plastic film one after another.

According to the present invention, a continuous plastic film is folded such that a linear cut or cuts provided at the respective folded sections are rightly superposed on one another. The plastic film is contained in a plastic film container such that an insert member or members are inserted through the linear cut or cuts thus superposed. When the film is to be drawn out, one end of the first section of film is drawn out to a predetermined length and then the film is cut away along the linear cut or cuts by means of the aforesaid insert member or members. When the film is cut away, one end of the succeeding, i.e. second, section of the film is automatically drawn out to the take-out opening through the action of connected portions other than the linear cut portions, thereby enabling achievement of the readiness of the pop-up take-out method as applied to tissue paper and the reliable take-out of the film sections one after another.

The preferable embodiment of the containing construction according to the present invention is such that an insert member or members for being inserted through a linear cut or cuts in the plastic film are provided on a plate member provided separately of the container, whereby the work of mounting the insert member or members onto the plate member is facilitated and the work of fastening of the plastic film and receiving the film in the container are automated, so that the serviceability of the film installing process can be improved and the film sections thus contained can be reliably taken out one after another.

DETAILED DESCRIPTION OF THE PREFERRED EMBODIMENTS

Figure 1:
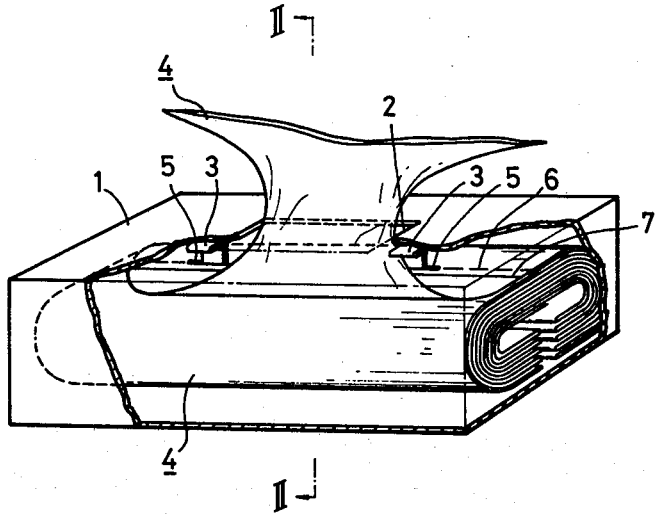
FIG. 1 is a perspective view, partially cut away, showing the general arrangement of a first embodiment of the construction for containing the plastic film according to the present invention.

Detailed description will hereunder be given of the embodiments of the present invention with reference to the drawings, in which same reference numerals are used to designate same or similar parts, so that the detailed description thereof need not be repeated.

Figure 2:
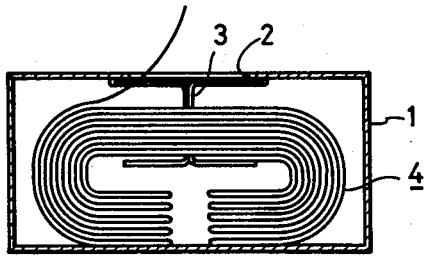
FIG. 2 is a sectional view in the direction indicated by the arrows from line II—II in FIG. 1.

FIGS. 1 and 2 show the first embodiment of the construction for containing the plastic film according to the present invention, in which a container 1 is made of paper board and formed into a hollow rectangular parallelepiped, and a rectangular take-out opening 2 is formed in the center of the upper surface of this container 1. Projectingly provided at the inner surface of the container 1 and at opposite sides in a longitudinal direction of the take-out opening 2, i.e. in a lateral direction in FIG. 1, are insert members 3 directed inwardly (downwardly) of the container 1. Each insert member 3 is formed of a soft-iron plate, in which an insert portion is formed of two layers capable of being bifurcated, and arranged in a T-shape in the initial state, not shown. Additionally, this insert member 3 is secured to the container 1 such that the former is bonded to the latter, or the former is formed with a bendable tongue or tongues, which are extended through the latter to the outside, where the tongue or tongues are bent to be fixed thereat.

Figure 3:
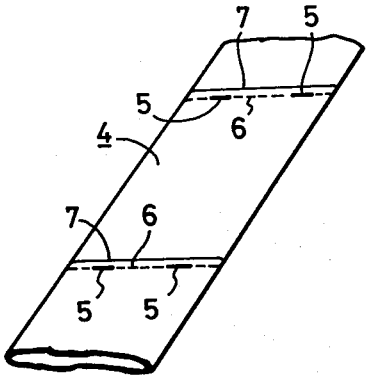
FIG. 3 is a fragmentary perspective view showing one embodiment of the plastic film used in the embodiment of FIG. 1.

Contained in the container 1 is a plastic film 4 in a folded state. This plastic film 4, as shown in FIG. 3 for example, is of such an arrangement that a continuous tubular film formed by the inflation method or the like is folded along lines perpendicular to the longitudinal direction of the plastic film to be formed into double wall portions. Linear cuts 5 penetrating through the double wall portion of the film 4 are formed in two lines at regular intervals in a crosswise direction at the intermediate portion of the folded portion of the continuous plastic film in the longitudinal direction of the film. Perforated lines 6 are formed along the lines of linear cuts over the entire length in the crosswise direction except at the linear cuts. The film 4 is connected in the longitudinal direction thereof at three portions in the crosswise direction, including at the central portion, by these portions of perforated lines 6. Furthermore, a heat seal portion 7 is formed by fusion bonding between the double walls adjacent and along the respective linear cuts 5 and perforated lines 6, and this heat seal portion 7 is formed over the entire length of the crosswise direction of the film 4 in parallel with the perforated lines 6, i.e., in a direction perpendicular to the longitudinal direction of the film 4.

Figure 4:
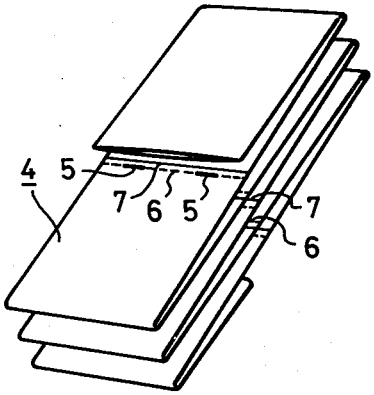
FIG. 4 is a perspective view showing the folded state of the plastic film of FIG. 3.

The above described film 4, as shown in FIG. 4, is staggeredly folded (folded in a Z-shaped manner) such that the respective linear cuts 5 are superposed on one another at the center. The thus folded, predetermined length sections of the film 4 are as shown in FIGS. 1 and 2, contained in the container 1 in the state of being bent into C-shapes downwardly open as viewed in looking toward the longitudinal side edges of the film 4. In this case, the aforesaid two insert members 3 are inserted through the linear cuts 5 thus superposed, and ends of the insert members 3, which have penetrated through all of the folded layers of the film 4, are bent towards opposite sides as shown in FIG. 2, so as to hold the film 4.

With the arrangement as described above, to take-out a predetermined length of the film 4, i.e., a section of the film 4 to form a bag, a forward end of the film 4, which has previously partially projected from the take-out opening 2, is drawn out. In this case, when the film 4 folded and contained in the container 1 is drawn out by a length of bag, an end of the film 4, constituting a second bag subsequent to the first one, engages the insert members 3 because the insert members 3 are inserted through the linear cuts 5, with the result that the opposite end portions and the central portions of the film 4, where the perforated lines 6 are formed, are torn off by a resisting force due to the above described engagement. When torn off, the film 4 is drawn out of the take-out opening 2 formed in the center of the container 1. Hence, when the film 4 is drawn out by a length of bag, part of the central portion of the succeeding portion of the film 4, connected to the first portion through the perforated lines 6, is drawn out of the take-out opening 2 because the linear cuts 5 of the film 4 have widths to some extent and no resisting force is generated until the insert members 3 inserted through the linear cuts 5 reach the opposite end portions of the film 4 where connections are effected through the perforated lines 6. If the draw-out operation is continued in this condition, the opposite end portions of the film 4 connected to the succeeding section of the film 4 through the perforated lines 6 engage the insert members 3 as if the former are wound around the latter. At this time, tensile forces act on the opposite end portions of the film 4, whereby, firstly, the perforated lines 6 at the opposite end portions begin to be cut. Thereafter, if the draw-out operation is further continued, a tensile force acts on the central portion of the film 4 due to a resisting force resulting from the engagement of the opposite end portions of the film 4 with the insert members 3, whereby the perforated line 6 at the central portion is cut. In consequence, part of the succeeding section of the film 4 should project out of the take-out opening 2 without fail.

With this embodiment as described above, the plastic film 4 can be reliably taken out in the same manner as in the pop-up take-out method of tissue paper, one section after another. Furthermore, the simplified construction thereof makes it possible to provide the containing construction at reduced cost.

Figure 5:
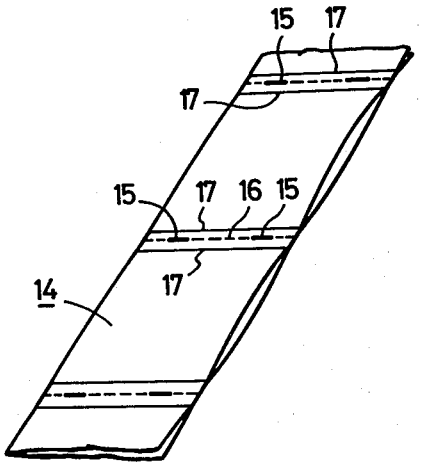
FIGS. 5 and 6 are fragmentary perspective views showing other embodiments of the plastic film according to the present invention, being different from each other.
Figure 6:
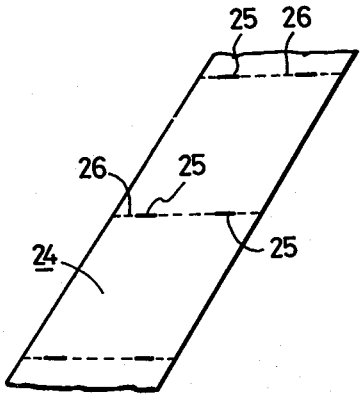

Furthermore, in working the present invention, in place of the plastic film 4, a plastic film 14 whose one longitudinal side edge is open, may be used as shown in FIG. 5, or a plastic film 24 formed of as a sheet may be used as shown in FIG. 6. The plastic film 14 shown in FIG. 5 is provided with two linear cuts 15 disposed at regular intervals in the longitudinal direction thereof, perforated lines 16 are provided at a position incorporating the linear cuts 15, and heat seal portions 17 are provided at both sides of the perforated lines 16. Further, the plastic film 24 shown in FIG. 6 is provided with two linear cuts 25 disposed at regular intervals in the longitudinal direction thereof, and perforated lines 26 are provided at a position incorporating the linear cuts 25. The same operations as those described above can be performed by use of these films 14 and 24. The perforated lines 6, 16 or 26 need not necessarily be provided, but the provision of those perforated lines can offer advantages that facilitate the tear-off operation. Further, the number of linear cuts 5, 15 or 25 need not be two, but may be reduced to one. When two linear cuts 5, 15 or 25 are present, if one of those linear cuts is disposed at an intermediate portion in the crosswise direction of the film 4, 14 or 24, then the other may be located to start from the side edge of the film 4, 14 or 24 with one portion thereof being cut open. However, when two linear cuts 5, 15 or 25 are provided at an intermediate portion in the crosswise direction of the film 4, 14 or 24 and the insert members 3 are inserted at opposite sides of the take-out opening, then there are presented advantages such that a resisting force present when the film 4, 14 or 24 is drawn through the connecting portions at opposite sides causes the succeeding section of the film 4, 14 or 24 to be reliably drawn out. Additionally, the bending of the plastic film 4, 14 or 24 in the container 1 need not be limited to a C-shape, but, may be of any other shape.

Figure 7:
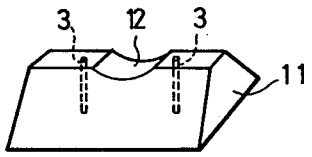
FIGS. 7 and 8 are perspective views showing other forms of the container according to the present invention, being different from each other.
Figure 8:
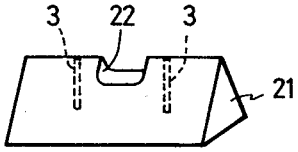

Further, the container 1 may be replaced by a container 11 having trapezoidal side surfaces as shown in FIG. 7, a container 21 having triangular side surfaces as shown in FIG. 8, or other containers having round side surfaces or elliptical side surfaces. Furthermore, the take-out opening 2 may be replaced by a take-out opening 12 of a circularly arcuate shape as viewed from the front as shown in FIG. 7, a take-out opening 22 of a U-shape as viewed from the front as shown in FIG. 8, or other take-out openings of a round or elliptical shape in plan view.

In the first embodiment described above, the insert members 3 are directly provided on the container 1. However, the insert members may be provided on a plate member 10 provided separately of the container 1 as in the second embodiment shown in FIGS. 9 and 10. More specifically, in FIGS. 9 and 10, a take-out opening 2 of an elliptical shape with opposite ends thereof cut away is formed in the center of the upper surface of the container 1, this take-out opening 2 is covered with a cover film 8 made of polyolefin, and the cover film 8 is provided at the central portion thereof with a linear cut 9 in the longitudinal direction of the take-out opening 2.

A plate member 10 slightly smaller than the inside dimensions of the container 1 and capable of being readily put into and taken out of the container 1 is disposed inside a surface of the container 1 where the take-out opening is formed. This plate member 10 is made of a material such as paper or plastics, but is not resticted in materal quality in particular.

Figure 9:
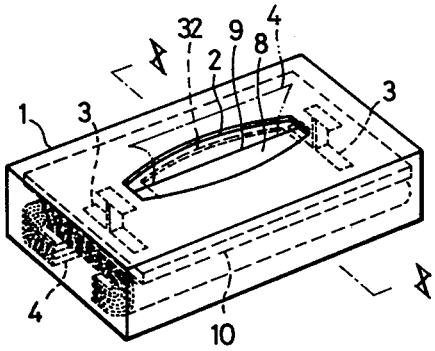
FIG. 9 is a perspective view, partially cut away, showing the general arrangement of a second embodiment of the construction for containing the plastic film according to the present invention.

Formed at the central portion of the above mentioned plate member 10 is a take-out opening 32 of an elliptical shape with opposite ends thereof cut away, corresponding to the take-out opening 2 of the container 1. The insert members 3 downwardly project at longitudinally opposite ends of this take-out opening 32 as seen in FIG. 9, and engage a surface of the plate member 10 opposite the surface thereof contacting an inner surface of the container 1, i.e., engage the undersurface of the plate member in FIG. 9. This insert member 3, in the same manner as in the above described first embodiment, is formed of a soft-iron plate, in which an insert portion is formed of two layers capable of being bifurcated, and arranged in a T-shape in the initial state, not shown. Additionally, these insert members 3 are secured to the plate member 10 by bonding or penetrating the plate member 10 with the insert members 3.

Figure 10:
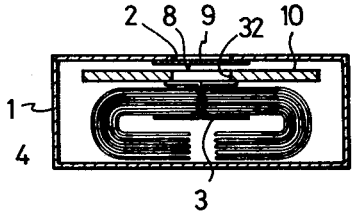
FIG. 10 is a sectional view in the direction indicated by the arrows from line X—X in FIG. 9.

The insert members 3 on the plate member 10 are inserted through the plastic film 4 in the folded state in the same manner as in the aforesaid first embodiment, in which the insert members 3 are directly provided on the container 1. The film 4 of the predetermined length in this state is contained in the container 1 in a condition where the film is folded substantially in a C-shape downwardly open as viewed in looking toward the longitudinal side edge of the film 4 shown in FIGS. 9 and 10. In this case, the aforesaid two insert members 3 are inserted through the superposed linear cuts 5, and the end portions of the insert members 3, which have penetrated through the film 4 as a whole, are bent to the opposite sides as shown in FIG. 10, so that the film 4 can be held. The film 4, thus engaged with the insert members 3 of the plate members 10 as described above, is contained together with the plate member 10 in the aforesaid container 1.

The process of manufacture of this second embodiment is such that, firstly, the insert members 3 are secured to the plate member 10 in the aforesaid manner, the insert members 3 are inserted through the linear cuts 5 of the folded film 5 to engage the film 4 with the insert members, and then the film 4 and the plate member 10 are integrally received in the container 1.

In this embodiment as described above, such a construction is adopted that the insert members 3 engaging the film 4 are provided on the plate member 10 formed separately of the container 1, so that the work of mounting the insert members 3 can be simplified and the work of engaging the film 4 with the insert members 3 can be performed outside the container 1, to thereby improve the serviceability and facilitate the automation of the manufacturing process.

Since the outside dimensions of the plate member 10 are slightly smaller than the inside dimensions of the container 1, the serviceability is improved when the inter-engaged plate member 10 and plastic film 4 are inserted into the container 1. Further, since the container 1 and the plate member 10 are only slightly different in dimensions, the possibility is eliminated that the movement of the plate member 10 after being placed in the container 1 could cause the take-out opening 2 of the container 1 and the take-out opening 32 of the plate member 10 to be offset from each other.

The polyolefin cover film 8 provided at the take-out opening 2 of the container 1 in this embodiment is intended mainly for improving the appearance of the container 1 and for excluding dust from the contained plastic film 4, and hence is not essential from the viewpoint of taking the film 4 out one piece after another.

Figure 11:
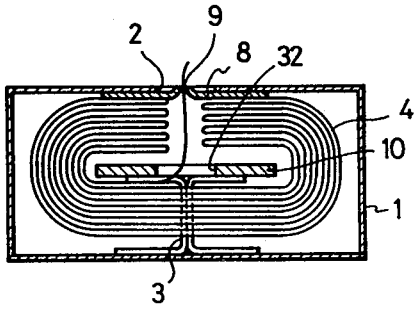
FIGS. 11 and 12 are sectional views showing the states of containing the plate member and the film according to the present invention, being different from each other.
Figure 12:
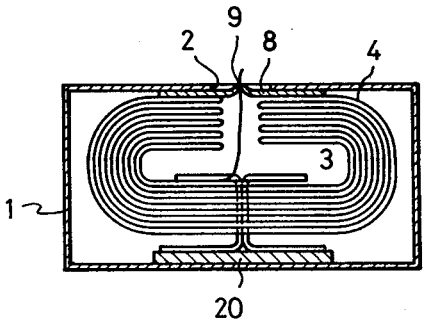

The orientation of the plastic film 4 in the container 1 need not be limited to the downwardly opening C-shape, but may be inverted, such that the C-shape opens upwardly towards the take-out opening 2 as shown in FIGS. 11 and 12. In this case, the plate member 10 may face toward the take-out opening 2 as shown in FIG. 11, or the insert members 3 may face toward the take-out opening 2 as shown in FIG. 12. When the insert members 3 face toward the take-out opening 2 as shown in FIG. 12, the plate member 20 is not required to have the take-out opening and only functions as a member for holding the insert members 3.

Figure 13:
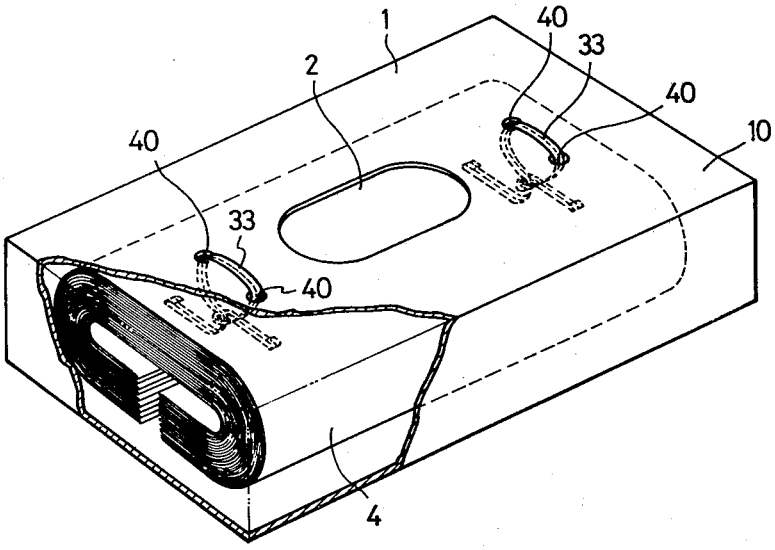
FIGS. 13 and 14 are perspective views, partially cut away, showing the general arrangements of other embodiments of the insert member according to the present invention, being different from each other.
Figure 14:
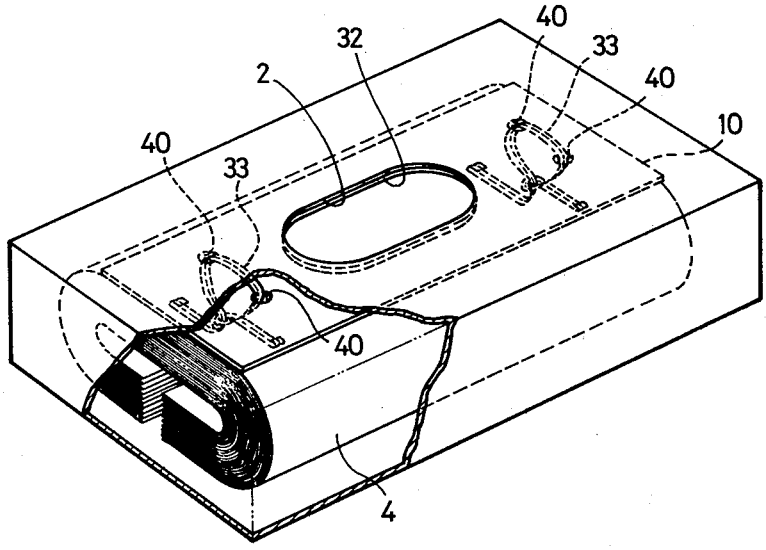

The insert members 3 need not be limited to ones formed of soft-iron plates as in the first and second embodiments, but may be insert members 33 formed of wire-reinforced plastic tapes as shown in the third and the fourth embodiments in FIGS. 13 and 14. More specifically, referring to FIGS. 13 and 14, the insert member 33 formed of the wire-reinforced tape may be of such an arrangement that the insert member 33 is once bent into substantially a U-shape, then opposite end portions thereof are inserted through a pair of mounting holes 40 penetratingly provided in the container 1 or the plate member 10, respectively, once twisted together, and thereafter extended to opposite sides, so as to engage the plastic film. Further, the insert member 33 may be formed of wires coated with a synthetic resin material or a rubbery material, or formed of wires only in place of the wire-reinforced plastic tape. Still further, the insert member 33 may be of a single bar shape, a plate shape, a cord shape, a thread shape or the like. In this case, the material of the insert member 33 should not necessarily be limited to the aforesaid soft-iron plate, wires or the like, but may be of other types of metal, wood, paper, plastics, fibers or other materials. When the insert member 33 is formed of a cord or a thread, the outer end portion of the insert member 33 is fixed somewhere in the container 1 or the opposing insert members 33 are connected to each other, for rigidity sufficient for tearing the film 4 off by means of the insert members 33.

Figure 15:
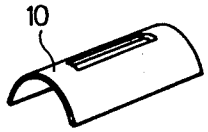
FIGS. 15 through 17 are perspective views showing the appearances of other embodiments of the plate member according to the present invention, being different from one another.
Figure 16:
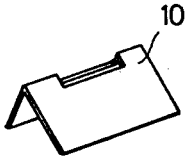
Figure 17:
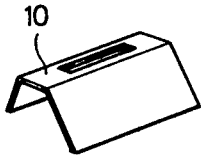
Figure 18:
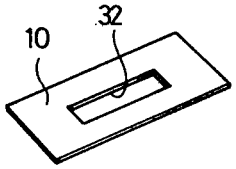
FIGS. 18 through 20 are perspective views showing other embodiments of the take-out opening provided on the plate member according to the present invention, being different from one another.
Figure 19:
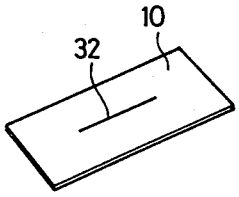
Figure 20:
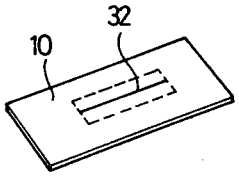

Furthermore, in the aforesaid second embodiment, the form of the plate member 10 need not necessarily be of a flat board, but may be of a three dimensional form, for example semicircular, triangular, trapezoidal or the like in cross section as shown in FIGS. 15 through 17. In this case of adopting one of the forms as described above, even if the remaining quantity of the film 4 becomes small, the plate member 10 will not sink to the bottom of the container 1, thereby offering the advantage that the take-out of the film 4 is facilitated. The shape of the take-out opening 32 formed at the center of the plate 10 may be a circular or elliptical one. Further, such shape may be a rectangular one or a slit-shaped one or a slit-shaped one with the both side edges thereof turned back or the like as shown in FIGS. 18 through 20, in addition to the elliptical one with the opposite end portions thereof being cut away as shown in the above described embodiment. Furthermore, the shape of the take-out opening 2 of the container 1 need not necessarily be limited to the elliptical one with the opposite end portions thereof cut away, but such shape may be circular, elliptical, rectangular, slit-shaped or slit-shaped with the both side edges thereof turned back or the like.

If the container 1 is fixed to a wall or the like by means of a bonding agent or a metal fixture, then it becomes possible to take out the plastic film by use of one hand only. In this case, if the above described embodiment using the plate member 10 is fixed to a wall or the like with the take-out opening 2 thereof facing straight downwardly, then, as the plastic film 4 is drawn out and reduced in quantity, the plate member 10 also descends straight downwardly, and hence the advantage results that even if the remaining portion of the plastic film 4 becomes small in quantity, the film 4 still can be easily taken out through the take-out opening 2.

What is claimed is:

1. A construction for containing a plastic film, comprising:

a continuous elongated strip of plastic film which is transversely partitioned along its length into a multiplicity of sections, said strip being provided with a multiplicity of longitudinally spaced-apart perforated lines extending in the crosswise direction of said strip and dividing said strip into said multiplicity of sections which are separable from each other, transversely extending linear cuts being formed in said strip at predetermined regular intervals along the longitudinal direction of said strip, said linear cuts being colinear with and forming part of said perforated lines, there being at least one of said cuts in each of said sections, said strip being folded back and forth upon itself in such a manner that said linear cuts are superposed on one another to form at least one set of cuts which are in registry with each other;

a container having a take-out opening, said strip being contained in said container and said sections being withdrawable from said container through said take-out opening; and at least one insert member provided in said container and inserted through said set of superposed linear cuts and adapted for causing one of said sections to be separated from said strip when said one section is withdrawn from said container.

2. A construction for containing a plastic film as set forth in claim 1, wherein said linear cuts are provided at two positions at a predetermined spacing in the crosswise direction of said strip so that successive sections of said strip are connected at three positions in the crosswise direction thereof, including at the center and opposite end portions thereof.

3. A construction for containing a plastic film as set forth in claim 1, wherein said insert member comprises an iron plate, and said insert member has an insert portion formed of two layers capable of being bifurcated, said insert portion extending through the superposed linear cuts associated therewith.

4. A construction for containing a plastic film as set forth in claim 1, wherein said insert member is formed of a wire-reinforced plastic tape.

5. A construction for containing a plastic film as set forth in claim 1, wherein said take-out opening is provided with a cover film disposed thereon in a manner so as to close said take-out opening, said cover film being formed with a linear cut therein for taking the plastic film out of said container therethrough.

6. A construction for containing a plastic film, comprising:

a continuous elongated strip of plastic film partitioned into a multiplicity of sections at predetermined regular intervals in the longitudinal direction of said film, said strip being provided with a multiplicity of longitudinally spaced-apart perforated lines extending in the crosswise direction of said strip and dividing said strip into said multiplicity of sections which are separable from each other, at least one linear cut being formed in the crosswise direction of each of said sections, said linear cuts being colinear with and forming part of said perforated lines, said continuous film being folded back and forth upon itself in such a manner that said linear cuts are superposed on one another to form at least one set of superposed linear cuts;

a container for containing said film including means for withdrawing said film from said container; and at least one insert member, one end of which is fixed to said container, said film thus folded being contained in said container in such a state that one insert member is inserted through each set of said superposed linear cuts.

7. A construction for containing a plastic film as set forth in claim 6, wherein said container is provided with a plastic film take-out opening having a cover film disposed thereon in a manner that closes said take-out opening, said cover film being formed with a linear cut therein for taking said plastic film out of said container therethrough.

8. A construction for containing a plastic film as set forth in claim 6 or claim 7, wherein said insert member is formed of an iron plate and includes an insert portion thereof which is formed of two layers capable of being bifurcated, said insert portion extending through the superposed linear cuts associated therewith.

9. A construction for containing a plastic film as set forth in claim 6 or claim 7, wherein said insert member is formed of a wire-reinforced plastic tape.

10. A construction for containing a plastic film, comprising:

a continuous elongated strip of plastic film partitioned into a multiplicity of sections at predetermined regular intervals in the longitudinal direction of said film, said strip being provided with a multiplicity of longitudinally spaced-apart perforated lines extending in the crosswise direction of said strip and dividing said strip into said multiplicity of sections which are separable from each other, at least one linear cut being formed in the crosswise direction of each of said sections of film, said linear cuts being colinear with and forming part of said perforated lines, said film being folded back and forth upon itself in such a manner that said linear cuts are superposed on one another to form at least one set of superposed linear cuts;

a container for containing said film including means for withdrawing said film from said container;

a plate member separate of the container and disposed inside of said container; and at least one insert member, one end of which is fixed to said plate member, said film thus folded being contained in the container in such a state that one insert member is inserted through each set of said superposed linear cuts.

11. A construction for containing a plastic film as set forth in claim 10, wherein said container is provided with a plastic film take-out opening having a cover film that closes said take-out opening, said cover film being formed with a linear cut therein for taking said plastic film out of said container therethrough.

12. A construction for containing a plastic film as set forth in claim 10 or claim 11, wherein said insert member is formed of an iron plate which includes an insert portion formed of two layers capable of being bifurcated, said insert portion extending through the superposed linear cuts associated therewith.

13. A construction for containing a plastic film as set forth in claim 10 or claim 11, wherein said insert member is formed of a wire-reinforced plastic tape.

14. A construction for containing a plastic film comprising:

a continuous elongated strip of plastic film having perforated lines incorporating at least one linear cut therein in the longitudinal direction thereof are formed at regular intervals in the crosswise direction of said strip, said strip being partitioned into a multiplicity of sections by said perforated lines at predetermined regular intervals in the longitudinal direction of said film, said film being folded back and forth upon itself in such a manner that said linear cuts are superposed in registry with one another to form at least one set of superposed linear cuts;

a container for containing said film including means for withdrawing said film from said container;

a plate member separate of the container, which is disposed in said container and has a plastic film take-out opening therein; and at least one insert member, one end of which is fixed to said plate member, said film thus folded being contained together with the plate member in the container in such a state that one insert member is inserted through said each set of said superposed linear cuts.

15. A construction for containing a plastic film as set forth in claim 14, wherein said container is provided with a plastic film take-out opening having a cover film that closes said take-out opening, said cover film being formed with a linear cut therein for taking the plastic film out of said container therethrough.

16. A construction for containing a plastic film as set forth in claim 14 or claim 15, wherein said insert member is formed of an iron plate which includes an insert portion thereof which is formed of two layers capable of being bifurcated, said insert portion extending through the superposed linear cuts associated therewith.

17. A construction for containing a plastic film as set forth in claim 14 or claim 15, wherein said insert member is formed of a wire-reinforced plastic tape.

18. A plastic film dispenser comprising:

a hollow container having a take-out opening in a top wall thereof;

a continuous, elongated, strip of plastic film inside said container, said strip having transverse lines of perforation at regularly spaced intervals along its length whereby said strip is partitioned into a multiplicity of easily separable sections, said transverse lines of perforation each including two transversely spaced, elongated cuts, said cuts being arranged in two sets, the cuts of each set being parallel with each other and being aligned with each other in the lengthwise direction of said strip, said sets of cuts being equidistant from the respective side edges of said strip, said strip being folded back and forth upon itself to form a stack of superposed layers, wherein all of said lines of perforation are disposed substantially in vertical registry with each other substantially midway between the lateral edges of said stack of superposed layers and the cuts of each set are vertically superposed in registry with each other, said folded strip being disposed in said container so that the upper end of said continuous strip is disposed in close proximity to said opening in said container and can be readily drawn therethrough; and two insert members disposed in substantially fixed positions within said container at opposite ends of said opening and inserted through said sets of cuts, respectively, said folded strip thereby being retained in said container, whereby when said upper end of said strip is drawn a sufficient distance out of said container, said film becomes taut between said end being drawn out and said insert members, and said film tears across the width thereof at the topmost one of said lines of perforation and one of said sections of said film is thereby drawn from said dispenser.

19. A dispenser as claimed in claim 18, wherein each of said insert members comprises an I-shaped bracket secured within said container and having a pair of upper and lower flange portions and a stem portion connecting said flange portions.

20. A dispenser as claimed in claim 19, further comprising a positioning member disposed within said container, said positioning member having a central opening therein, which central opening is aligned with said opening in said container, said positioning member being secured to said brackets, and said positioning member being of a size and shape such that the assembly of said positioning member and said brackets cannot substantially move within said container.

21. A dispenser as claimed in claim 18, wherein said container is a substantially rectangular hollow box, said opening in said container being elongated in the lengthwise direction of said rectangular box.

22. A dispenser as claimed in claim 18, wherein each of said insert members comprises a wire-reinforced plastic tape.

23. A dispenser as claimed in claim 22, wherein said plastic tape comprises a loop portion, an intertwined portion adjoining said loop portion and a pair of laterally extending legs adjoining said intertwined portion, said intertwined portion extending through the associated set of superposed linear cuts, said loop portion being threaded through a pair of spaced-apart holes in the top wall of said container such that said insert member is secured to said container, and said laterally extending legs act to retain said folded film on said intertwined portion of said wire reinforced plastic tape.

* * * * *